US010093009B2

(12) United States Patent
Hu

(10) Patent No.: US 10,093,009 B2
(45) Date of Patent: Oct. 9, 2018

(54) HAMMER TACKER

(71) Applicant: APEX MFG. CO., LTD., Taichung (TW)

(72) Inventor: Chih-Wei Hu, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 381 days.

(21) Appl. No.: 15/000,765

(22) Filed: Jan. 19, 2016

(65) Prior Publication Data

US 2017/0173774 A1 Jun. 22, 2017

(30) Foreign Application Priority Data

Dec. 22, 2015 (TW) ..... 104143133 A

(51) Int. Cl.

| | |
|---|---|
| ***B25C 5/06*** | (2006.01) |
| ***B25C 5/11*** | (2006.01) |
| ***B25C 1/02*** | (2006.01) |
| ***B25C 5/02*** | (2006.01) |
| ***B25C 5/16*** | (2006.01) |
| *B25D 1/00* | (2006.01) |

(52) U.S. Cl.

CPC ..... *B25C 5/11* (2013.01); *B25C 1/02* (2013.01); *B25C 5/0285* (2013.01); *B25C 5/1613* (2013.01); *B25D 1/005* (2013.01); *B25C 5/06* (2013.01); *B25D 1/00* (2013.01)

(58) Field of Classification Search

CPC .. B25C 5/00; B25C 5/02; B25C 5/025; B25C 5/0285; B25C 5/06; B25C 5/11; B25C 5/16; B25C 1/02; B25C 1/06; B25C 7/00; B25D 1/005; B25D 1/00

USPC ... 227/133, 134, 128, 8, 148, 132, 120, 131, 227/147, 109, 156

See application file for complete search history.

(56) References Cited

U.S. PATENT DOCUMENTS 1,687,871 A * 10/1928 Maynard ..... B25C 5/11 227/128
2,432,853 A * 12/1947 Barclay ..... B25D 1/005 227/133
2,463,579 A * 3/1949 Vail ..... B25D 1/005 227/133
2,552,798 A * 5/1951 Lindstrom ..... B25D 1/005 227/133

(Continued)

FOREIGN PATENT DOCUMENTS

TW I380884 B 1/2013

*Primary Examiner* — Scott A. Smith
(74) *Attorney, Agent, or Firm* — Muncy, Geissler, Olds & Lowe, P.C.

(57) ABSTRACT

The hammer tacker includes a shell, a handle, and a striking mechanism. The shell is made of a mixture of fiberglass and nylon by injection molding. The shell encloses a receiving room and has a bottom opening extending along the longitudinal direction of the shell and communicating with the receiving room. The handle is disposed on the rear end of the shell. The striking mechanism is made of metal and includes a magazine and a striker. The magazine is received in the receiving room. An end of the magazine is pivotally connected to the rear end of the shell, and the other end tends to move outward due to an elastic element. At end of the striker is disposed on the inner wall of the shell. When the magazine is hit upward, the striker strikes the nails out.

7 Claims, 6 Drawing Sheets

(56) References Cited

U.S. PATENT DOCUMENTS 2,661,999 A * 12/1953 Morris ..... B25D 1/005 227/133
2,769,173 A * 11/1956 Lindstrom ..... B25C 5/16 227/127
2,896,210 A * 7/1959 Rubin ..... B25D 1/005 227/133
3,113,317 A * 12/1963 Carlson, Sr. ..... B25D 1/005 227/128
5,263,628 A * 11/1993 Huang ..... B25C 5/025 227/134
5,421,502 A * 6/1995 Huang ..... B25C 5/025 227/134
5,857,608 A * 1/1999 Liau ..... B25C 5/025 227/113
6,012,623 A * 1/2000 Fealey ..... B25C 5/11 227/133
6,550,660 B1 * 4/2003 Chlebowski ..... B25C 5/11 227/131
6,802,443 B2 * 10/2004 Lu ..... B25C 5/11 227/109
6,863,204 B2 * 3/2005 Lu ..... B25C 5/11 227/109
7,506,789 B2 * 3/2009 Shor ..... B25C 5/1693 227/147
7,975,892 B2 * 7/2011 Yeh ..... B25C 5/1613 227/133
8,006,884 B2 * 8/2011 Ebbesson ..... B25C 5/11 227/109
8,146,789 B2 * 4/2012 Hu ..... B25C 5/06 227/120
9,776,313 B2 * 10/2017 Hu ..... B25C 5/11
2007/0057010 A1 * 3/2007 Byrne ..... B25C 5/11 227/133
2008/0173690 A1 * 7/2008 Lamb ..... B25C 5/1693 227/133
2010/0001033 A1 * 1/2010 Chen ..... B25C 5/11 227/120
2011/0248065 A1 * 10/2011 Hu ..... B25C 5/06 227/120
2011/0248066 A1 * 10/2011 Hu ..... B25C 5/16 227/127

* cited by examiner

HAMMER TACKER

BACKGROUND OF THE INVENTION

Field of the Invention

The present invention relates to a hammer tacker.

Description of the Prior Art

A conventional hammer tacker shown in patent TW 1380884 includes two half-shells and a striking mechanism received therebetween. The plate-shaped half shells are formed with metal sheets by bending or perforating them. The metal sheets are difficult to process, so the shape of the shell is restricted. Thus, striking mechanism has to be positioned to the shell by extra pieces.

Besides, the metal shell is heavy for a user to handle, and there must be some gaps between the metal shell and the metal striking mechanism so that noises and shaking are inevitable during striking.

SUMMARY OF THE INVENTION

The main object of the present invention is to provide a hammer tacker having reduced weight and making less noise and shaking.

To achieve the above and other objects, a hammer tacker of the present invention includes a shell, a handle, and a striking mechanism.

The shell is made of a mixture of fiberglass and nylon by injection molding wherein the mixture is composed of 30% to 70% of fiberglass by weight and 70% to 30% of nylon by weight. The shell has a first end and a second end at two opposite ends of the shell along a longitudinal direction thereof. The shell encloses a receiving room and has a bottom opening. The bottom opening extends along the longitudinal direction of the shell and communicates with the receiving room. The handle is connected to the second end of the shell. The striking mechanism is made of metal. The striking mechanism includes a magazine and a striker. The magazine is arranged in the receiving room. The magazine has a third end and a fourth end at two opposite ends along a longitudinal direction thereof. The fourth end of the magazine is pivotally connected to the second end of the shell. The third end of the magazine positionally corresponds to the first end of the shell. The magazine is under an elastic force by an elastic element so that the third end of the magazine tends to move outward away from the striker. An end of the striker is disposed on an inner wall of the shell, and an other end of the striker corresponding to the magazine. The third end of the magazine moves toward the striker when the third end of the magazine is hit upward so that nails in the magazine is stroke out by the striker.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
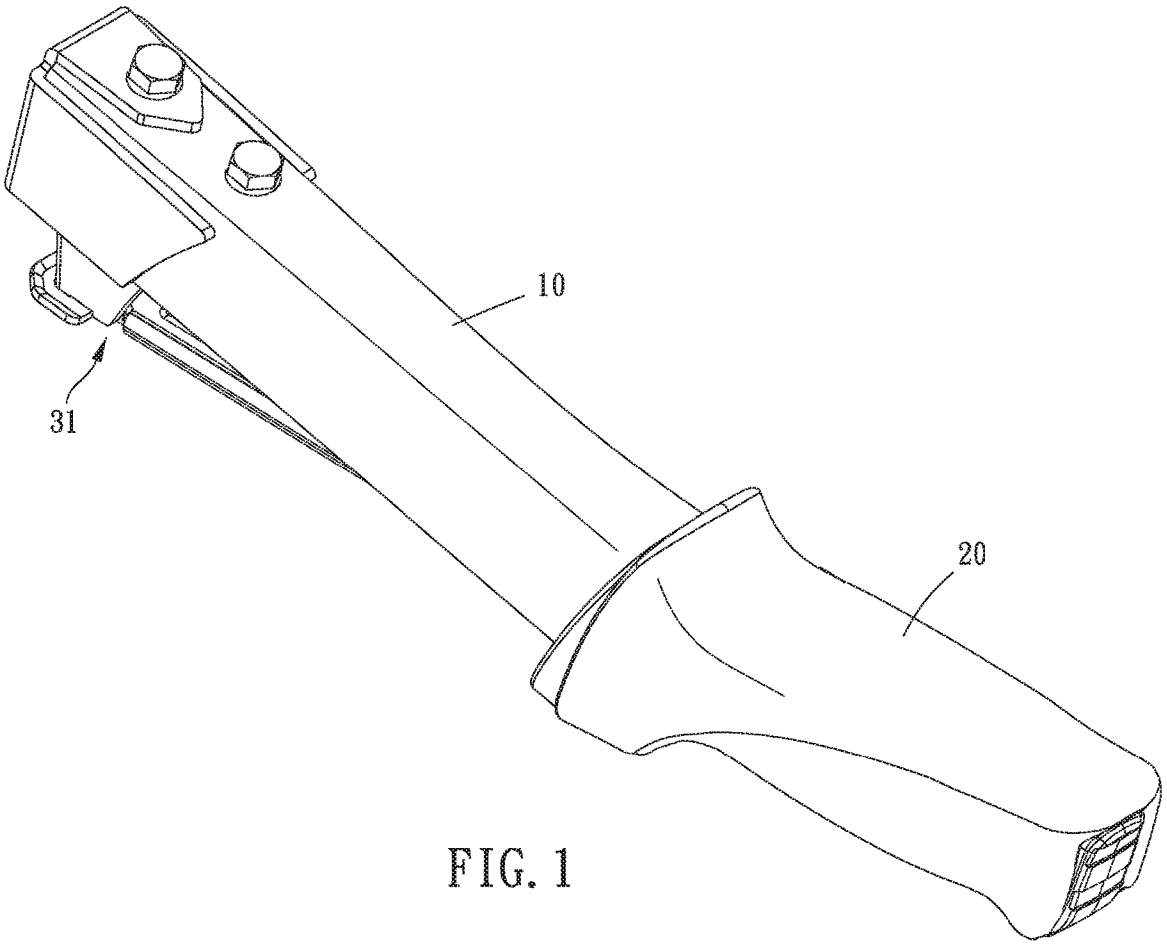
FIG. 1 is a stereogram showing a first embodiment of the present invention.

Please refer to FIGS. 1 to 6, the hammer tacker of the present invention includes a shell 10,10*a*, a handle 20,20*a*, and a striking mechanism.

The shell 10,10*a* is made of a mixture of fiberglass and nylon by injection molding wherein the mixture is composed of 30% to 70% of fiberglass by weight and 70% to 30% of nylon by weight. Preferably, the mixture is composed of 50% of fiberglass by weight and 50% of nylon by weight, and the fiberglass and the nylon are blended and granulated and then form the shell 10,10*a* by injection molding. The shell 10,10*a* has a first end and a second end at two opposite ends thereof along a longitudinal direction of the shell 10,10*a*. The shell 10,10*a* encloses a receiving room and has a bottom opening extending along the longitudinal direction and communicating with the bottom opening. The handle 20,20*a* is connected to the second end of the shell 10,10*a*. The striking mechanism is made of metal and includes a magazine 31,31*a* and a striker 32,32*a*. The magazine 31,31*a* is arranged in the receiving room. The magazine 31,31*a* has a third end and a fourth end at two opposite ends along a longitudinal direction thereof. The fourth end of the magazine 31,31*a* is pivotally connected to the second end of the shell 10,10*a*. The third end of the magazine 31,31*a* corresponds to the first end of the shell 10,10*a*. The magazine 31,31*a* is under an elastic force by an elastic element 33,33*a* so that the third end of the magazine 31,31*a* tends to move outward. Preferably, the elastic element 33,33*a* is an elastic plate. An end of the elastic plate is fixed to the inner wall of the shell 10,10*a* facing to the magazine 31,31*a*, and an other end of the elastic plate abuts against the magazine 31,31*a*. An end of the striker 32,32*a* is disposed on the inner wall of the shell 10,10*a*, an other end of the striker 32,32*a* positionally corresponds to the magazine 31,31*a*. When the third end of the magazine 31,31*a* is hit upward, the third end of the magazine 31,31*a* is moved toward the striker 32,32*a* so that the nails in the magazine 31,31*a* is stroke out by the striker 32,32*a*.

Figure 2:
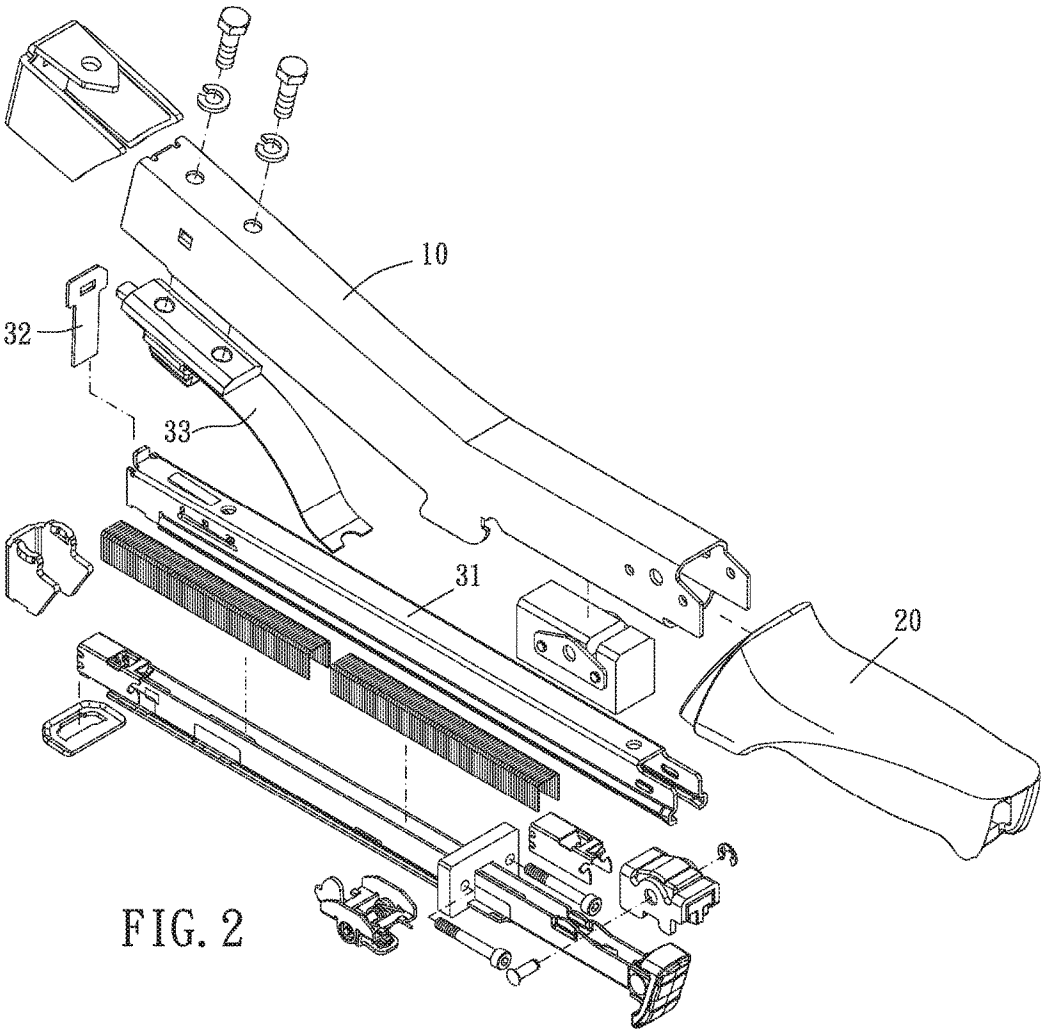
FIG. 2 is a breakdown drawing showing a first embodiment of the present invention.
Figure 3:
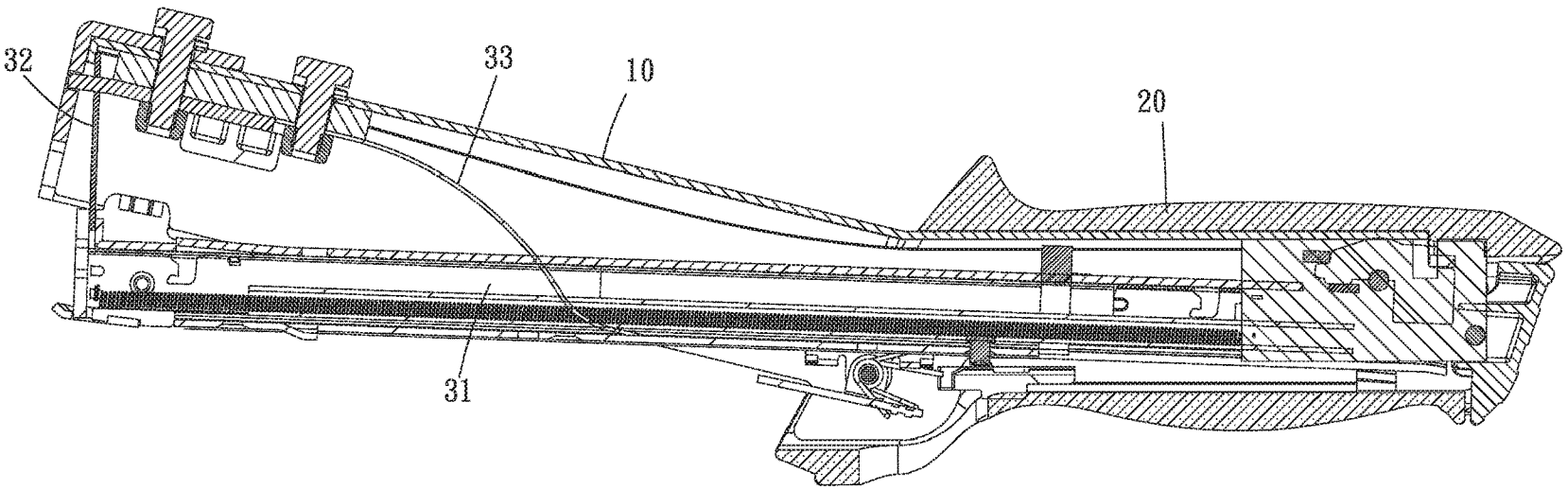
FIG. 3 is a profile showing a first embodiment of the present invention.

Furthermore, in the first embodiment of the present invention, as shown in FIGS. 1 to 3, the handle 20 is sleeved onto the second end of the shell 10 and extends to a portion of the shell 10 between the first end and the second end. The shell 10 has an abutting portion in a predetermined distance from the second end. The abutting portion is adapted for a lower end of the magazine 31 to abut against so that the magazine 31 is unable to pivot downward unlimitedly. Besides, the magazine 31 comprises a limiting rail and a nail rail wherein the limiting rail covers the nail rail and is pivotally connected to the shell 10. The nail rail is filled with nails and is able to be pulled backward for refilling the nails. The shell 10 has a positioning element near the abutting portion. The positioning element is selectively inserted into a positioning hole on the nail rail to prevent the nail rail from being pulled backward.

Figure 4:
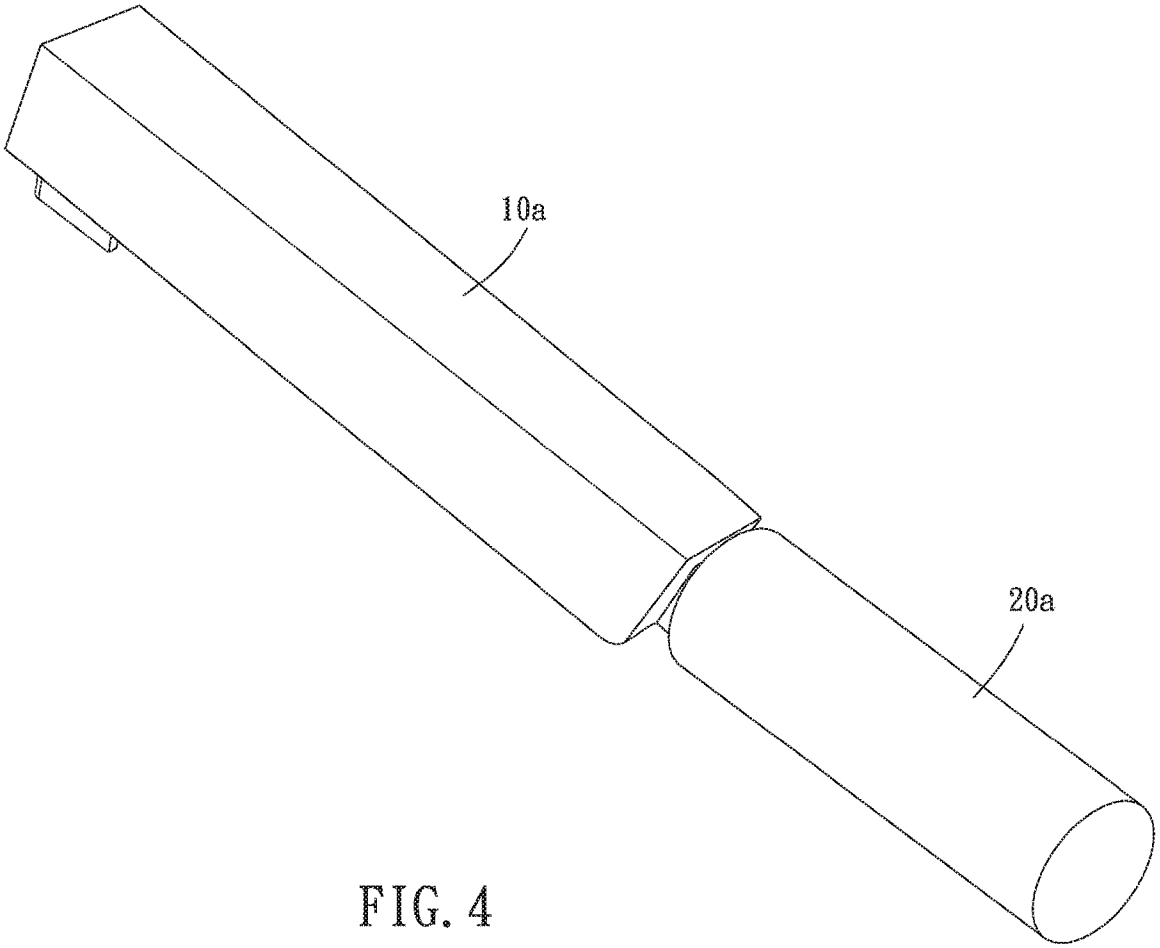
FIG. 4 is a stereogram showing a second embodiment of the present invention.
Figure 5:
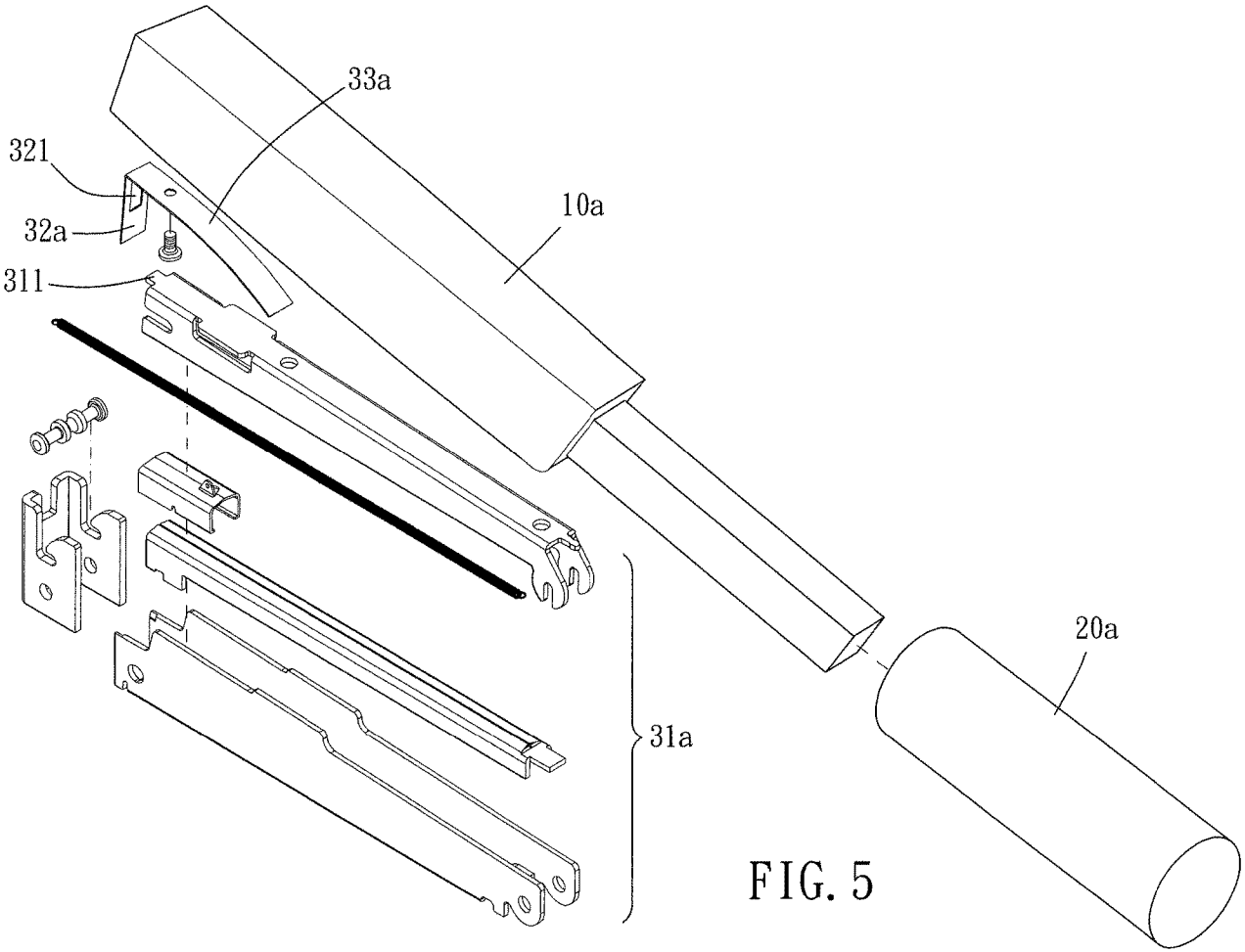
FIG. 5 is a breakdown drawing showing a second embodiment of the present invention.
Figure 6:
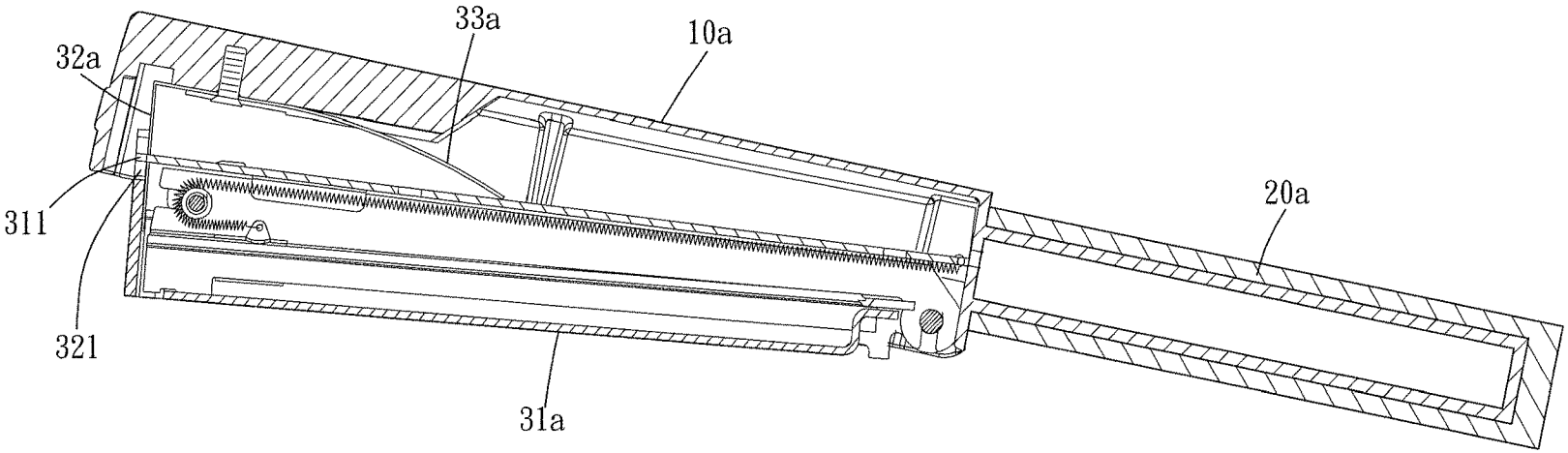
FIG. 6 is a profile showing a second embodiment of the present invention.

In the second embodiment, as shown in FIGS. 4 to 6, the shell 10*a* has a terminal end extending from the second end away from the first end. The handle 20*a* is sleeved onto the terminal end. That is, the magazine 31*a* is substantially pivotally arranged in front of the handle 20*a*. The magazine 31*a* has a structure similar to the stapler. Specifically, the striker 32*a* is formed with an elongated slot 321, and the magazine 31*a* is formed with a protrusion 311 inserted into the elongated slot 321 to be linearly slidable along the elongated slot 321. Thus, the maximum pivot angle of the magazine 31*a* is restricted.

In conclusion, the hammer tacker of the present invention has a shell made of special material. As a result, the weight is reduced, and the noise and the shaking are also reduced. Besides, the shell is easy to manufacture due to the injection molding procedures so that the cost is also reduced. In addition, the pivoting magazine makes the structure easier.

What is claimed is:

1. A hammer tacker, including:

a shell, made of a mixture of fiberglass and nylon by injection molding wherein the mixture is composed of 30% to 70% of fiberglass by weight and 70% to 30% of nylon by weight, the shell having a first end and a second end at two opposite ends of the shell along a longitudinal direction thereof, the shell enclosing a receiving room and having a bottom opening, the bottom opening extending along the longitudinal direction of the shell and communicating with the receiving room;

a handle, connected to the second end of the shell;

a striking mechanism, made of metal, including a magazine and a striker, the magazine being arranged in the receiving room, the magazine having a third end and a fourth end at two opposite ends along a longitudinal direction thereof, the fourth end of the magazine being pivotally connected to the second end of the shell, the third end of the magazine positionally corresponding to the first end of the shell, the magazine being under an elastic force by an elastic element so that the third end of the magazine tends to move outward away from the striker, an end of the striker being disposed on an inner wall of the shell, an other end of the striker corresponding to the magazine, the third end of the magazine moving toward the striker when the third end of the magazine is hit upward so that nails in the magazine is stroke out by the striker.

2. The hammer tacker of claim 1, wherein the mixture is composed of 50% of fiberglass by weight and 50% of nylon by weight.

3. The hammer tacker of claim 1, wherein the fiberglass and the nylon are granulated and then form the shell by injection molding.

4. The hammer tacker of claim 1, wherein the handle is sleeved onto the second end of the shell and extends to a portion of the shell between the first end and the second end.

5. The hammer tacker of claim 1, wherein the elastic element is an elastic plate, an end of the elastic plate is fixed to an inner wall of the shell facing the magazine, an other end of the elastic plate abuts against the magazine.

6. The hammer tacker of claim 1, wherein the shell is further formed with a terminal end from the second end away from the first end, the handle is sleeved onto the terminal end.

7. The hammer tacker of claim 1, wherein the striker is formed with an elongated slot, the magazine is formed with a protrusion inserted through the elongated slot to be slidable along the elongated slot.

* * * * *